US008202676B2

(12) United States Patent
Hasegawa

(10) Patent No.: US 8,202,676 B2
(45) Date of Patent: Jun. 19, 2012

(54) TONER FOR DEVELOPING ELECTROSTATIC LATENT IMAGE, AND IMAGE FORMING METHOD USING THE TONER

(75) Inventor: Kumi Hasegawa, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 620 days.

(21) Appl. No.: 12/348,478

(22) Filed: Jan. 5, 2009

(65) Prior Publication Data

US 2009/0176169 A1 Jul. 9, 2009

(30) Foreign Application Priority Data

Jan. 9, 2008 (JP) ..... 2008-001847

(51) Int. Cl.
*G03G 9/00* (2006.01)

(52) U.S. Cl. ..... 430/108.1; 430/108.3; 430/109.1; 430/123.57

(58) Field of Classification Search ..... 430/59.4, 430/108.1, 123.57, 118.4, 119.81
See application file for complete search history.

(56) References Cited

U.S. PATENT DOCUMENTS

| | | | | |
|---|---|---|---|---|
| 5,288,577 | A * | 2/1994 | Yamaguchi et al. | 430/111.2 |
| 5,298,950 | A | 3/1994 | Tanikawa | |
| 5,747,210 | A | 5/1998 | Emoto et al. | |
| 5,769,931 | A * | 6/1998 | Wang et al. | 106/31.38 |
| 6,221,549 | B1 | 4/2001 | Emoto et al. | |
| 6,303,257 | B1 | 10/2001 | Hasegawa et al. | |
| 6,432,590 | B1 | 8/2002 | Ueda et al. | |
| 6,468,706 | B2 | 10/2002 | Matsuda et al. | |
| 6,544,704 | B1 | 4/2003 | Matsuda et al. | |
| 6,899,986 | B2 | 5/2005 | Aoki et al. | |
| 6,924,073 | B2 | 8/2005 | Higuchi et al. | |
| 6,964,835 | B2 | 11/2005 | Hasegawa et al. | |
| 7,029,816 | B2 | 4/2006 | Sasaki et al. | |
| 7,150,954 | B2 | 12/2006 | Aoki et al. | |
| 7,163,774 | B2 | 1/2007 | Shiraishi et al. | |
| 7,183,029 | B2 | 2/2007 | Masuda et al. | |
| 7,217,485 | B2 | 5/2007 | Hasegawa et al. | |
| 2002/0039698 | A1 | 4/2002 | Sasaki et al. | |
| 2005/0208403 | A1 | 9/2005 | Shu et al. | |
| 2006/0051692 | A1 | 3/2006 | Hasegawa et al. | |
| 2006/0063092 | A1 | 3/2006 | Hasegawa et al. | |
| 2006/0068306 | A1 | 3/2006 | Shu et al. | |
| 2006/0093943 | A1 | 5/2006 | Shu et al. | |
| 2007/0287083 | A1 * | 12/2007 | Gondoh et al. | 430/58.35 |
| 2008/0102393 | A1 | 5/2008 | Hasegawa | |
| 2008/0220360 | A1 | 9/2008 | Hasegawa | |

FOREIGN PATENT DOCUMENTS

| | | | |
|---|---|---|---|
| CN | 1808291 | A | 7/2006 |
| EP | 1 160 293 | A2 | 12/2001 |
| EP | 1 341 052 | A1 | 9/2003 |
| JP | 2000-321819 | | 11/2000 |
| JP | 2002-53539 | | 2/2002 |
| JP | 2003-255617 | | 9/2003 |
| JP | 2007-148301 | | 6/2007 |

OTHER PUBLICATIONS

Office Action issued Aug. 31, 2011, in Chinese Patent Application No. 200910002030.5.

U.S. Appl. No. 12/092,585, filed May 5, 2008, Kumi Hasegawa.

* cited by examiner

*Primary Examiner* — Thorl Chea

(74) *Attorney, Agent, or Firm* — Oblon, Spivak, McClelland, Maier & Neustadt, L.L.P.

(57) ABSTRACT

A toner for developing electrostatic latent images, including a binder resin; and a colorant, wherein the toner further includes propyleneglycolmonomethylether in an amount of from 30 to 200 ppm.

10 Claims, 6 Drawing Sheets

RANK 5

RANK 3

RANK 1

TONER FOR DEVELOPING ELECTROSTATIC LATENT IMAGE, AND IMAGE FORMING METHOD USING THE TONER

BACKGROUND OF THE INVENTION

1. Field of the Invention

The present invention relates to a toner for developing an electrostatic latent image, and to an image forming method using the toner.

2. Discussion of the Background

The electrophotographic image forming methods are broadly classified to dry developing methods and wet developing methods. The dry developing methods are further classified to one-component and two-component developing methods. A toner used in any methods needs to be positively or negatively charged, according to the polarity of an electrostatic latent image. A charge controlling agent is most effectively added to the toner to maintain a charge of the toner.

A variety of charge controlling agents are available, and chrome-containing complex compounds have conventionally been used because of being inexpensive and negatively charging. Japanese published unexamined application No. 2000-321819 discloses a toner including a chrome-containing complex compound and a polyester resin having an acid value of from 15 to 30 mg KOH/g. Although this improves an edge of negative chargeability, the developer initially has no problem but noticeably deteriorates in its chargeability as time passes in an environment of high humidity because the polyester resin varies due to environment.

Japanese published unexamined application No. 2003-255617 discloses a charge controlling agent having a specific X-ray diffraction pattern, with which a developer does not deteriorate in its chargeability in an environment of high humidity. In addition, even when a carrier is charged low, the developer has high transferability, producing images having good granularity without producing foggy images. However, toner are having smaller particle diameters to improve image quality and toners having a particle diameter 7.0 μm need further charging buildability. When a charge controlling agent is included in a toner too much to increase charging buildability, the toner has higher elasticity because the charge controlling agent works as a filler, resulting in deterioration of low-temperature fixability of the toner. Japanese published unexamined application No. 2002-53539 discloses a toner including a charge controlling agent which is a mono azo gold-bearing compound having a purity not less than 90%. The toner has high negative chargeability but the durability thereof is unknown at all. Above all, when a toner has a small particle diameter, the toner recycled is an ultra fine powder, resulting in noticeable poor charging buildability thereof.

Because of these reasons, a need exists for a toner having high colorability and maintaining low-temperature fixability without producing foggy images even after used or stored at high temperature for long periods.

SUMMARY OF THE INVENTION

Accordingly, an object of the present invention is to provide a toner having high colorability and maintaining low-temperature fixability without producing foggy images even after used or stored at high temperature for long periods.

Another object of the present invention is to provide an image forming method using the toner.

A further object of the present invention is to provide a process cartridge using the toner.

These objects and other objects of the present invention, either individually or collectively, have been satisfied by the discovery of a toner for developing electrostatic latent images, comprising:

a binder resin; and a colorant, wherein the toner further comprises propyleneglycolmonomethylether in an amount of from 30 to 200 ppm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein.

DETAILED DESCRIPTION OF THE INVENTION

Figure 1:
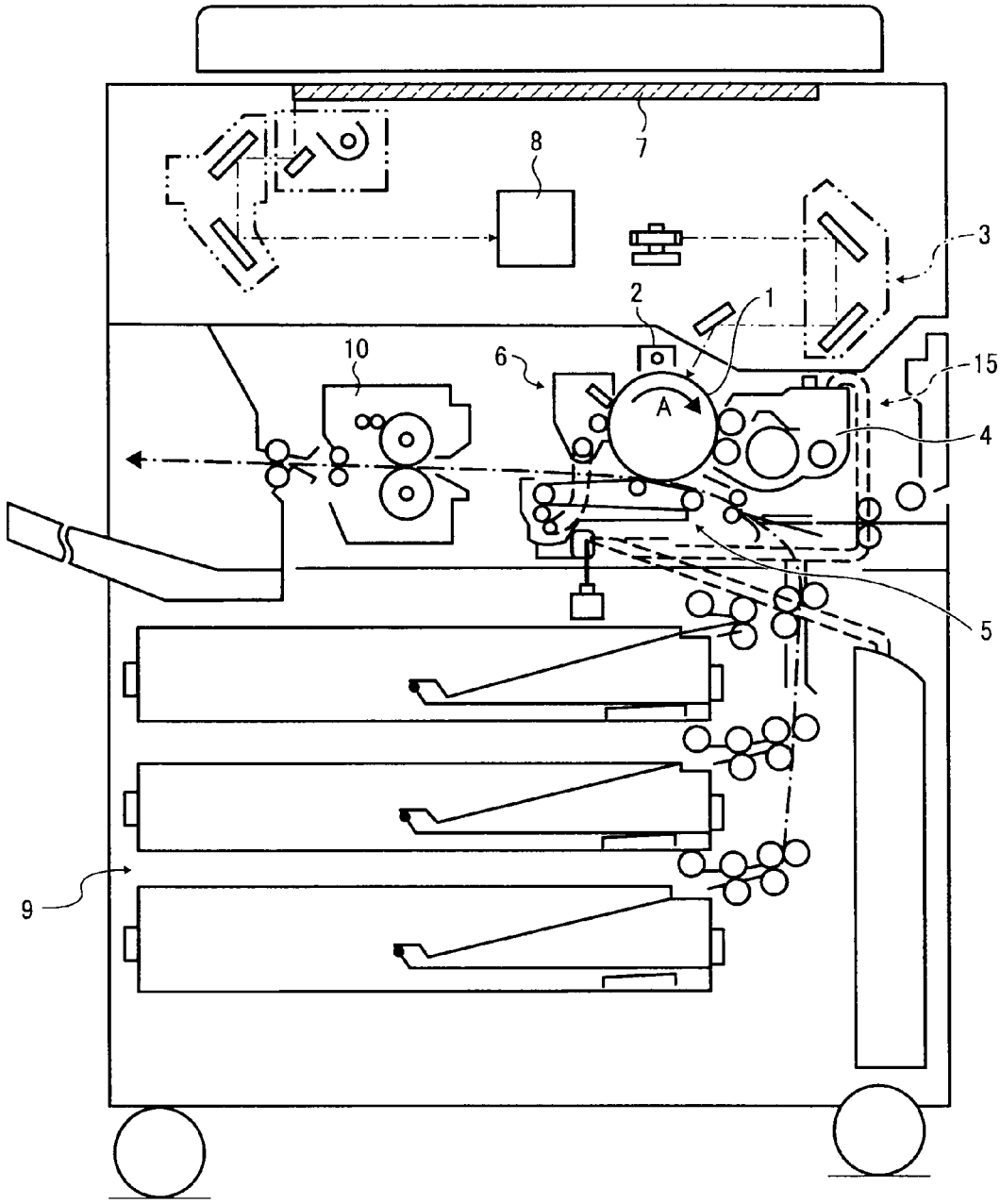
FIG. 1 is a schematic view illustrating an embodiment of digital copiers.

The present invention provides a toner having high colorability and maintaining low-temperature fixability without producing foggy images even after used or stored at high temperature for long periods. More particularly, the present invention relates to a toner for developing electrostatic latent images, comprising:

a binder resin; and a colorant, wherein the toner further comprises propyleneglycolmonomethylether in an amount of from 30 to 200 ppm.

Such a toner has high colorability. Propyleneglycolmonomethylether has high solubility even to a material having a different solubility parameter and compatibility between a resin and a wax increases. Therefore, the toner has high durability without spent wax and deterioration due to aggregation even after used or stored at high temperature for long periods. In addition, when the resin or wax in the toner melts when fixed, propyleneglycolmonomethylether is a good solvent for both of them and the resultant images have high smoothness after fixed and has high image density. When less than 30 ppm, spent wax occurs and foggy images are produced after used or stored at high temperature for long periods. When greater than 200 ppm, the surface of the toner is partly softened when store for long periods in an environment having a temperature higher than 50° C., resulting in deterioration of the fluidity of the toner. Particularly when polyester resins having low compatibility with a wax are used alone as a binder resin, propyleneglycolmonomethylether included in a toner in an amount of from 30 to 200 ppm works as a wax dispersant and the toner has high durability without spent wax even after used for long periods.

Further, the toner preferably has a weight-average particle diameter of from 3.5 to 6.5 μm, and a variation coefficient of number distribution (standard deviation of number distribution/number-average particle diameter) of from 22.0 to 35.0 to have high colorability. Having a weight-average particle diameter less than 3.5 μm, the toner deteriorates in its cleanability, resulting in production of foggy images and deterioration of the colorability. Having a weight-average particle diameter greater than 6.5 μm, the resultant images deteriorates in sharpness and colorability. Particularly in a recycle system, a toner having a variation coefficient of number distribution (standard deviation of number distribution/number-average particle diameter) of from 22.0 to 35.0 has higher colorability. In the recycle system, the toner has small variations of fluidity and chargeability, and produces images without deterioration even when mixed with a recycled toner. When less than 22.0, having a sharp particle diameter distribution, the toner produces good images at the beginning, but when mixed with a recycled toner, the particle diameter distributions of the initial toner and the recycled toner are completely separate and the initial toner is preferentially developed while the recycled toner is accumulated undeveloped in an image developer, resulting in spent carrier and aggregation of a developer. When greater than 35.0, the particle diameter distribution is so wide that the toner having a specific distribution is preferentially developed, resulting in the same phenomena. The toner having a variation coefficient of number distribution (standard deviation of number distribution/number-average particle diameter) of from 22.0 to 35.0 has good chargeability and fluidity, and produces images having high image density without such phenomena because the recycled toner is consumed even when mixed with a recycled toner.

In order to prepare a toner including propyleneglycolmonomethylether in an amount of from 30 to 200 ppm, the propyleneglycolmonomethylether is added to a toner as a monomer or dissolved in a resin-synthesizing solvent because of having high solubility in water and various organic solvents. The solvent is removed after synthesizing the resin. The content thereof is controlled by an input thereof or a temperature and a time in the process of removing the solvent. However, when included in a resin of a toner, the propyleneglycolmonomethylether thermally expands the resin when stored for long periods at higher than 50° C. (not at room temperature) and softens the surface of the toner. Then, an external additive is partly buried in the toner, resulting in deterioration of the fluidity thereof.

The toner preferably includes a chrome-containing monoazo compound as a charge controlling agent, which is synthesized in propyleneglycolmonomethylether and subjected to de-solvent, including propyleneglycolmonomethylether in an amount of from 0.3 to 0.9% by weight and having the following formula (1):

(1)

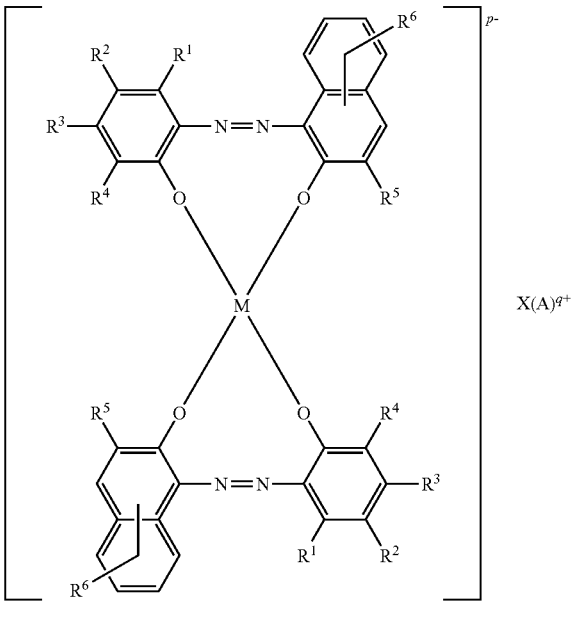

wherein $R^2$ is Cl; $R^1$ and $R^3$ to $R^6$ are hydrogen atoms; M is Cr; $(A)^{q+}$ is $H^+$; p is an integer 1 or 2, and X is an integer of 1 or 2.

An enzyme bonded with chrome which is a central metal in a crystalline structure of the chrome-containing monoazo compound having the formula (1) and the propyleneglycolmonomethylether are coordinated to grow the crystal, and the propyleneglycolmonomethylether does not volatilize even when stored for long periods at higher than 50° C. and the toner maintains its storage stability.

When the toner includes 2-ethoxyethanolethylcellosolve, the crystalline structure has a main peak at Bragg angle (2θ) of 8.70° having a lattice spacing a bit smaller than that of 8.68° in a CuKα X-ray diffraction spectrum when irradiated with the CuKα X-ray at an angle (2θ) of from 5 to 30°. Namely, when the toner includes propyleneglycolmonomethylether, the crystalline structure has a main peak at Bragg angle (2θ) in a range of from 8.64 to 8.68°, having a lattice spacing. When the peak strength is from 7,000 to 13,000 cps at a tube voltage of 50 KV and a tube current of 30 mA, the charge controlling agent has high crystallinity and negative chargeability, and the crystalline structure thereof is not damaged with a heat energy when kneaded. When less than 7,000 cps, the negative chargeability deteriorates. When greater than 13,000 cps, the charge controlling agent increases in crystallinity and aggregability, and has insufficient dispersibility in a toner, resulting in production of foggy images.

The chrome-containing monoazo compound having the formula (1) preferably includes propyleneglycolmonomethylether in an amount of from 0.3 to 0.9% by weight. A toner including such a chrome-containing monoazo compound has good chargeability and produces images having high image density for long periods. When less than 0.3% by weight, the chrome-containing monoazo compound deteriorates crystallinity and negative chargeability. When greater than 0.9% by weight, the chrome-containing monoazo compound increases in aggregability and has insufficient dispersibility in a toner, resulting in production of foggy images.

When the toner of the present invention, having high chargeability, high transfer efficiency with a sharp particle diameter distribution and good fluidity even after stored after long periods is used in an image forming method including a process of charging an image bearer with a charger a voltage is applied to from outside; a process of forming an electrostatic latent image on the charged image bearer; a process of developing the electrostatic latent image with a toner to form a toner image; a process of transferring the toner image onto a transfer body with a transferer a voltage is applied to from outside; a process of cleaning the image bearer with a cleaner after the toner image is transferred; and a process of fixing a toner image on a recording material upon application of heat, the image forming method produces quality images without producing foggy images. The toner of the present invention, having good fluidity even after stored after long periods does not deteriorate in chargeability and fluidity with a heat in an image forming apparatus. The toner of the present invention, having high transfer efficiency and being less untransferred has very high suitability for a toner recycle system. Therefore, the image forming method produces quality images having high image density.

FIG. 1 is a schematic view illustrating an embodiment of digital copiers. The digital copier in FIG. 1 uses a known electrophotographic method and includes a drum-shaped photoreceptor 1. Around the photoreceptor 1, a charger 2, an irradiator 3, an image developer 4, a transferer 5, a cleaner 6, a recycler 15 and a fixer 10, which perform an electrophotographic duplication process, are located along with a rotating direction indicated by an arrow A.

The irradiator 3 forms an electrostatic latent image on the photoreceptor 1 based on an image signal from a scanner 8 scanning an original located on an original setting table 7 on the copier.

The electrostatic latent image formed on the photoreceptor 1 was developed by the image developer 4 to form a toner image thereon, and the toner image is electrostatically transferred by the transferer 5 onto a transfer sheet fed by a paper feeder 9. The transfer sheet having the toner image thereon is transported to the fixer 10 fixing the toner image thereon and discharged out of the copier.

On the other hand, the photoreceptor 1 having a part from which the toner has not been transferred or a stain is cleaned by the cleaner 6. The toner cleaned by the cleaner is collected by the recycler 15 into a toner hopper and mixed with a toner supplied from outside. The mixed toner is retuned to the image developer 4 and ready for the following image forming step.

Recently, a charger, a transferer and a cleaner contact a photoreceptor to decrease ozone, and a charging roller or a charging blade, a transfer belt and a cleaning blade are used. Therefore, a toner tends to adhere to these members because they directly contact a photoreceptor. However, a toner for use in the image forming method of present invention is preferably used in such a method. This is because the number of reversely charged toner is small as the toner has a sharp charge distribution, and an amount of a residual toner is small as the toner has high transferability. In addition, as one of a mechanism of the toner adherence, an agglutinated charge controlling agent on a surface of the toner occasionally separates therefrom and becomes a core of progress of the toner adherence. However, because a charge controlling agent for use in the image forming method of the present invention has good dispersibility with other materials of the toner, the charge controlling agent does not agglutinate on the surface of the toner and does not become a core of the toner adherence. Therefore, fusion bonding of a toner does not occur even in a contact charging process, a contact transfer process and a contact cleaning process.

The charging roller or a charging blade, a transfer belt and a cleaning blade are preferably formed of an electroconductive rubber.

Having high chargeability, a sharp charge distribution and good charge stability at high temperature and high humidity, the toner for use in the image forming method of the present invention forms uniform and precise images on transfer papers. Further, one or two rollers having elasticity in the fixing process contacts the surface of the toner image closer to the transfer paper, and there is less uneven fixation, image density and gloss. Therefore, the resultant images are not crushed after fixed and have good granularity and high definition.

Figure 2:
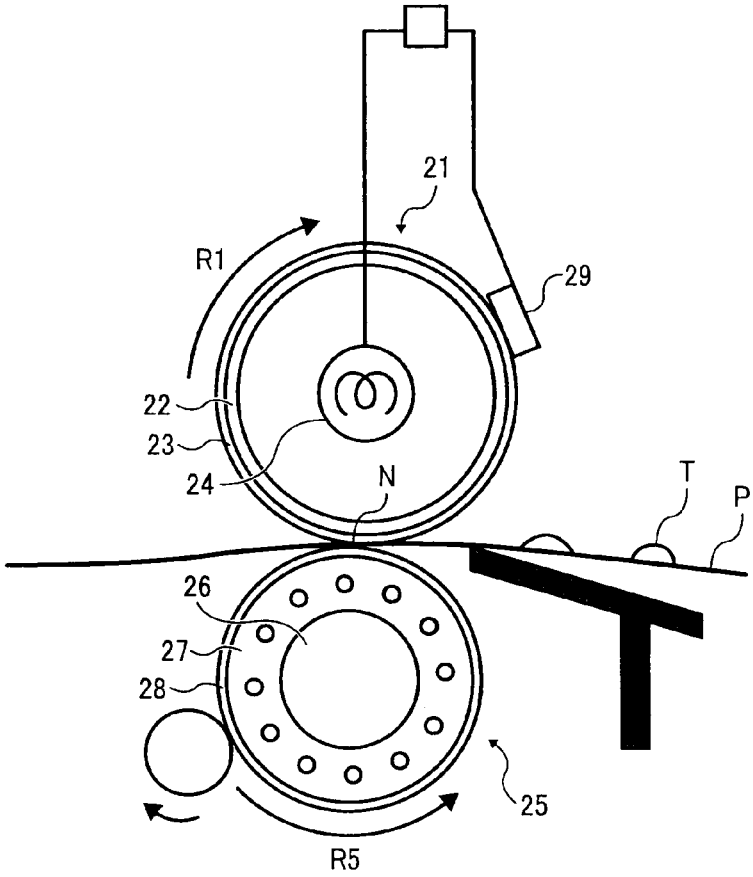
FIG. 2 is a schematic view illustrating an embodiment of heat-roller fixers.

A fixer including one or two rollers having elasticity will be explained in detail. FIG. 2 is a schematic view illustrating an embodiment of heat-roller fixers, including a fixing roller 21 having a heater 24 such as halogen lamps and a pressure roller 25 having an elastic layer 27 such as foamed silicone rubbers on a metal core 26, which is pressurized by the fixing roller 11. A release layer 28 formed of a PFA tube, etc. is formed on the elastic layer 27 of the pressure roller 25. The fixing roller 21 includes an elastic layer 27 formed of silicone rubbers, etc. on a metal core (not shown), and further a resin layer 23 formed of resins such as fluorocarbon resins having good releasability on the elastic layer 27 for the purpose of preventing adherence of a toner. The elastic layer 27 preferably has a thickness of from 100 to 500 μm in consideration of the resultant image quality and heat conduction efficiency in fixing the image. The resin surface layer 23 is formed of a PFA tube, etc. similarly to the pressure roller 25, and preferably has a thickness of from 10 to 50 μm in consideration of mechanical deterioration thereof. A temperature detector 29 is formed on a peripheral surface of the fixing roller 21, which detects a surface temperature thereof and controls the heater 24 to maintain a fixed temperature. The fixing roller 21 and pressure roller 26 contact with each other by a predetermined pressure to form a fixing nip portion N, and driven by a driver (not shown) and rotated in directions of R1 and R5 respectively such that the nip portion N sandwiches and transports a transfer material P. The fixing roller 21 is controlled to have a predetermined temperature by the heater 24, and a toner image T on the transfer material P is heated and melted while pressurized between the rollers. The toner image T is cooled after passing between the rollers and fixed on the transfer sheet P as a permanent image.

The elastic layer 27 of the pressure roller 25 has an outer diameter of 30 mm and a radial thickness of 6 mm, and the roller is coated with an electroconductive PFA tube. Hardness of a rubber of the elastic layer 27 is 42 HS (Asker C). The metal core of the fixing roller 11 is made of aluminium and has a radial thickness of 0.4 mm. A pressure of 88 N is applied to both ends of the rollers to form the nip N and a surface pressure is 9.3 $N/cm^2$.

Any known binder resins can be used in the toner of the present invention. Specific examples of the resins include styrene resins such as polystyrene, poly-α-methylstyrene, styrene-chlorostyrene copolymers, styrene-butadiene copolymers, styrene-vinylchloride copolymers, styrene-vinylacetate copolymers, styrene-maleic acid copolymers, styrene-ester acrylate copolymers, styrene-α-methylchloroacrylate copolymers and styrene-acrylonitrile-ester acrylate copolymers (polymers or copolymers including styrene or styrene substituents); polyester resins; epoxy resins; vinylchloride resins; rosin-modified maleic acid resins; phenol resins; polyethylene resins; polypropylene resins; petroleum resins; polyurethane resins; ketone resins; ethylene-ethylacrylate copolymers, xylene resins; and polyvinylbutyral resins. Particularly, the polyester resins are preferably used.

The polyester resin can be obtained from a condensed polymerization between alcohol and a carboxylic acid. Specific examples of the alcohol include glycols such as ethyleneglycol, diethyleneglycol, triethyleneglycol and propyleneglycol; etherified bisphenol such as 1,4-bis (hydroxymethyl)cyclohexane and bisphenol A; units obtained form a dihydric alcohol monomer; and units obtained from a tri-or-more hydric alcohol monomer. Specific examples of the carboxylic acids include units obtained from a dihydric organic-acid monomer such as maleic acid, fumaric acid, phthalic acid, isophthalic acid, terephthalic acid, succinic acid and malonic acid; and units obtained from a tri-or-more hydric carboxylic-acid monomer such as 1,2,4-benzenetricarboxylic acid, 1,2,5-benzenetricarboxylic acid, 1,2,4-cyclohexanetricarboxylic acid, 1,2,4-naphthalanetricarboxylic acid, 1,2,5-hexanetricarboxylic acid, 1,3-dicarboxyl-2-methylenecarboxypropane and 1,2,7,8-octantetracarboxylic acid. The polyester resin preferably has a glass transition temperature (Tg) of from 58 to 75° C. These resins can be used alone or in combination.

In addition, manufacturing methods of these resins are not particularly limited and any methods such as mass polymerization, solution polymerization, emulsion polymerization and suspension polymerization can be used.

A wax can be used in the toner for use in the present invention to improve releasability of the toner when fixed. Specific examples of the waxes include polyolefin waxes such as polypropylene wax and polyethylene wax; and natural waxes such as candelilla wax, rice wax and carnauba wax. The toner preferably includes the wax in an amount of from 0.5 to 10 parts by weight.

Any pigments and dyes conventionally used as colorants for a toner can be used as a colorant included in the toner for use in the present invention. Specific examples of the colorants include carbon black, lamp black, iron black, ultramarine blue, nigrosin dyes, aniline blue, chalco Oil Blue, oil black, azo oil black, etc. However, these are not limited thereto. The toner preferably includes the colorant in an amount of from 1 to 10, and more preferably from 3 to 7 parts by weight.

An additive can optionally be included in the toner for use in the present invention. Specific examples of the additives include silica, aluminium oxides, titanium oxides. As a fluidizer, a hydrophobized silica or a rutile type fine-particle titanium dioxide preferably having an average particle diameter of from 0.001 to 1 μm, and more preferably from 0.005 to 0.1 μm can optionally be used. Particularly, an organic silane surface-treated silica or titania is preferably used. The toner preferably includes the additive in an amount of from 0.1 to 5%, and more preferably from 0.2 to 2% by weight.

In addition, when the toner of the present invention is used as a two-component dry toner, as a carrier for use in the developer, a powder having including glass, iron, ferrite, nickel zircon, silica, etc. as a main component and having a particle diameter of from about 30 to 1,000 μm or the powder coated with styrene-acrylic resins, silicone resins, polyamide resins, polyvinylidene fluoride resins, etc. can optionally be used.

Method of producing the toner of the present invention includes at least a mixing process, a kneading process upon application of heat, a pulverizing process and a classifying process of a developer including a binder resin, a main charge controlling agent and a colorant. In addition, the methods include a method of recycling a powder besides particles to be used for a toner in a pulverizing or a classifying process into a mechanical mixing process or a kneading process upon application of heat.

The powder besides particles to be used for a toner (by-product) means fine particles and coarse particles besides toner particles having a desired particle diameter in the pulverizing process or the following classifying process. When such a by-product is mixed or kneaded upon application of heat with original materials, the by-product is preferably has a content of 1 part by weight or 50 parts by weight based on total weight of the toner materials.

A conventional mixer having a rotating blade can be used in the mechanical mixing process of a developer including at least a binder resin, a main charge controlling agent, a colorant and the by-product in conventional conditions without any particular conditions.

After the mixing process, the mixture is kneaded upon application of heat in a kneader. A uniaxial or biaxial continuous kneader and a batch type kneader with a roll mill can be used.

It is important that the kneading process is performed in proper conditions so as not to cut a molecular chain of the binder resin. Specifically, a temperature of the kneading process upon application of heat is determined in consideration of a softening point of the binder resin. When the temperature is lower than the softening point, the molecular chain of the binder resin is considerably cut. When higher than the softening point, the dispersion does not proceed well.

After the kneading process upon application of heat, the mixture is pulverized. In this pulverizing process, the mixture is preferably crashed, and then pulverized. The mixture is preferably pulverized by being crashed to a collision board in a jet stream, and pulverized by being passed through a narrow gap between a mechanically rotating rotor and a stator. After the pulverizing process, the pulverized material is classified by a centrifugal force, etc. in a stream of air to prepare a toner having a predetermined particle diameter, e.g., of from 5 to 20 μm. In addition, an external additive, i.e., inorganic fine particles such as hydrophobic silica fine powders can be added to the thus prepared toner. A conventional powder mixer can be used to mix the external additive, and is preferably equipped with a jacket to control an inside temperature. In order to change a load to the external additive, the external additive may be added on the way of mixing process or gradually added to the toner. As a matter of course, the number of revolutions, a rolling speed, a time of mixing and a temperature of the mixer may be changed. A large load at the beginning and a small load later may be applied to the additive, and vice versa.

Specific examples of the mixers include a V-type mixer, a locking mixer, a Loedige Mixer, a Nauta Mixer, a Henschel Mixer, etc.

X-ray diffractometer RINT1100 from Hitachi, Ltd. and CuKα ray are used to measure the X-ray diffraction in the present invention under the following conditions:

X-ray tube bulb: Cu

Tube voltage: 50 kV

Tube current: 30 mA
Scanning speed: 2°/min
Divergence slit: 1°
Scattering slit: 1°
Light-receiving slit: 0.2 mm Propyleneglycolmonomethylether is measured by GC/MS.

1. Method of Preparing a Measurement Sample

<Propyleneglycolmonomethylether in Chrome-Containing Monoazo Compound>

Precisely-weighed 0.01 g of a chrome-containing monoazo compound is stirred with 0.5 ml of dimethylformamide in a measuring flask having a capacity of 10 ml to prepare a mixture. A mixed solvent including 2 parts by weight of chloroform and 98 parts by weight of n-hexane is dropped in the mixture while stirred to prepare an extraction liquid. The extraction liquid is subjected to centrifugation at 5,000 rpm for 10 min to prepare another extraction liquid, i.e., a measurement sample.

<Propyleneglycolmonomethylether in a Toner or a Resin>

Precisely-weighed 0.01 g of a toner or a resin is stirred by an ultrasonic with 0.5 ml of chloroform for one min in a measuring flask having a capacity of 10 ml to prepare a mixture. Methanol is dropped in the mixture while stirred to prepare an extraction liquid. The extraction liquid is subjected to centrifugation at 5,000 rpm for 10 min to prepare another extraction liquid, i.e., a measurement sample.

2. GC/MS Measurement Conditions

Gas chromatography equipment 5890 from Hewlett-Packard Co. and a mass spectrometer SX-102A from JEOL Ltd. are used.

Column: DB-WAX (J&W) having a polyethyleneglycol layer, a length of 30 m, an inner diameter of 0.25 mm and a thickness of 0.25 μm.

GC conditions
Injection temperature: 150° C.
Column flow rate: 3.0 ml/min
Carrier gas: helium gas
Split ratio: 1/20
Input: 1.0 μl
Column temperature: starting at 50° C. and maintains 50° C. fro 3 min, and increases up to 150° C. at 20° C./min and maintains 150° C. fro 1 min
Detector temperature: 220° C.

MS conditions
Ion source: EI+
Ionization voltage: 70 eV
Ionization current: 300 μA
Accelerating voltage: 8.0 kV
Collector slit: 300 μm
CD voltage: 10 kV
Ion multi: −1.5 kV
Amp: F/1
Interface temperature: 220° C.

In the present invention, particle diameters are measured by Coulter Multisizer II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following 13 channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

Figure 3:
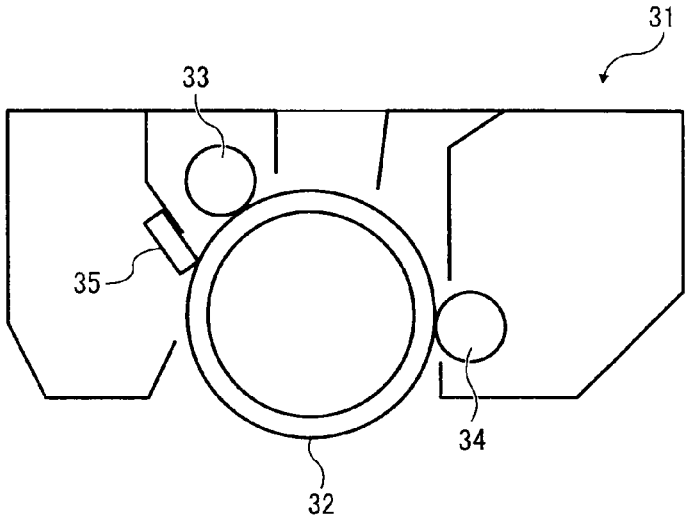
FIG. 3 is a schematic view illustrating an embodiment of the process cartridge of the present invention.

FIG. 3 is a schematic view illustrating an embodiment of the process cartridge of the present invention.

In FIG. 3, numeral 31 represents a whole process cartridge, 32 is a photoreceptor, 33 is a charger, 34 is an image developer and 35 is a cleaner.

Two or more of the photoreceptor 32, the charger 33, the image developer 34 and the cleaner 35 are combined in a body as the process cartridge, and which is detachable from image forming apparatuses such as copiers and printers.

In an image forming apparatus having the process cartridge of the present invention, including an image developer, a photoreceptor rotates at a predetermined peripheral speed. The circumferential surface of the photoreceptor is positively or negatively charged evenly by a charger in the process of rotating. Next, the circumferential surface is irradiated by an irradiator such as slit irradiators and laser beam scanning irradiators with imagewise light to from an electrostatic latent image thereon. The electrostatic latent image is developed by an image developer with a toner to form a toner image. The toner image is transferred by a transferer onto a transfer material synchronously fed between the photoreceptor and the transferer. The transfer material having received the toner image separates from the photoreceptor and comes into a fixer where the toner image is fixed thereon, and the transfer material the toner image is fixed on is printed out as a copy. The surface of the photoreceptor is cleaned by a cleaner removing the toner remaining untransferred thereon, and further discharged to be ready to form a following image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES (Synthesis of Resin 1)

300 g of ion-exchanged water and 10 g of propyleneglycolmonomethylether were placed and stirred in a flask having a cooling tube, a stirrer, a gas inlet tube, a thermometer and a capacity of 31 to prepare a mixture. A mixed monomer including 184 g of styrene and 16 g of n-butylacrylate, 3 g of di-t-butylperoxide as a starter, and 0.8 g of divinylbenzene and 3 g of sodium dodecylbenzenesulfonate as crosslinkers were dropped in the mixture while stirred. Further, the mixture was heated to have a temperature of 90° C. and subjected to a reaction for 12 hrs to prepare a polymeric material. The polymeric material was washed with water and dried at a room temperature and 10 torr to prepare a resin 1 including propyleneglycolmonomethylether in an amount of 350 ppm.

(Synthesis of Resin 2)

The procedure for preparation of Resin 1 was repeated to prepare a resin 2 except for not placing 10 g of propyleneglycolmonomethylether. The resin 2 included propyleneglycolmonomethylether in an amount of 0 ppm.

(Synthesis of Resin 3)

551 g of polyoxypropylene(2,2)-2,2-bis(4-hydroxyphenyl)propane, 463 g of polyoxyethylene(2,2)-2,2-bis(4-hydroxyphenyl)propane, 191 g of fumaric acid, 189 g of 1,2,4-benzenetricarboxylic acid and 8 g of tin dioctanoate were placed in a four-opening flask made of glass having a capacity of 31, attached with a thermometer, a stainless stirring bar, a flow-down condenser and a nitrogen inlet tube to prepare a mixture. The mixture was subjected to a reaction while stirred at 210° C. at the first half under a nitrogen stream in an electrothermal mantle heater. The reaction was terminated when a softening point of the mixture reached 120° C. according to ASTM E28-67 to prepare a resin 3. The resin 3 included propyleneglycolmonomethylether in an amount of 0 ppm.

(Synthesis of Chrome-Containing Monoazo Compound 1)

(a) Synthesis of Monoazo Pigment

The following materials were mixed to prepare an aqueous solution.

| | |
|---|---|
| Water | 300 ml |
| Hydrochloric acid | 20.0 g |
| 4-chlor-2-aminophenol | 28.6 g |

After the aqueous solution was cooled to have a temperature of 5° C., a solution including 60 ml of water and 14.0 g of sodium nitrite dissolved therein was dropped in the aqueous solution for 30 min to prepare a mixture. After the mixture was stirred at a temperature of from 5 to 15° C. to prepare a reaction liquid, the reaction liquid was filtered to prepare an aqueous solution (solution A) of a diazonium salt of 4-chlor-2-aminophenol.

Next, the following materials were mixed to prepare an aqueous solution.

| | |
|---|---|
| Water | 400 ml |
| Sodium hydroxide | 14.0 g |
| 2-naphthol | 28.8 g |

After the solution A was dropped in the aqueous solution for 40 min to prepare a mixture, the mixture was stirred for 3 hrs to filter a reaction deposit out. The reaction deposit was washed and dried at 100° C. to prepare 62.0 g of 1-(5-chlor-2hydroxyphenyl)azo-2-hydroxynaphthalene (monoazo pigment).

The following materials were mixed to prepare a mixture.

| | |
|---|---|
| Monoazo pigment prepared in (a) | 62.0 g |
| Chrome formate | 19.2 g |
| Propyleneglycolmonomethylether | 200 ml |

After the mixture was heated to have a temperature of 120° C. at 10° C./min and stirred for 8 hrs, the mixture was cooled to have a temperature of 5° C. at 7° C./min to prepare a reaction liquid. After a solid content was filtered from the reaction liquid through a paper filter and the solid content was washed with 100 ml of water on the paper filter to prepare a wet cake. The wet cake was re-dispersed in an aqueous medium including 200 ml of water and 15 g of hydrochloric acid, and stirred for 1 hr. Then, after a solid content was filtered out again and washed with 1,200 ml of water, the solid content was dried at 100° C. for 5 hrs and pulverized to prepare a chrome-containing monoazo compound 1.

The chrome-containing monoazo compound 1 included propyleneglycolmonomethylether in an amount of 0.3% by weight, and has a main peak at Bragg angle (2θ) of 8.680 in a CuKα X-ray diffraction spectrum. The peak strength was 13,000 cps at a tube voltage of 50 KV and a tube current of 30 mA.

(Synthesis of Chrome-Containing Monoazo Compound 2)

The following materials were mixed to prepare a mixture.

| | |
|---|---|
| Monoazo pigment prepared in (a) | 62.0 g |
| Chrome formate | 19.2 g |
| Propyleneglycolmonomethylether | 200 ml |

After the mixture was heated to have a temperature of 120° C. at 5° C./min and stirred for 8 hrs, the mixture was cooled to have a temperature of 10° C. at 10° C./min to prepare a reaction liquid. After a solid content was filtered from the reaction liquid through a paper filter and the solid content was washed with 100 ml of water on the paper filter to prepare a wet cake. The wet cake was re-dispersed in an aqueous medium including 200 ml of water and 15 g of hydrochloric acid, and stirred for 1 hr. Then, after a solid content was filtered out again and washed with 1,200 ml of water, the solid content was dried at 80° C. for 1 hr and further dried at 100° C. for 2 hrs, and pulverized to prepare a chrome-containing monoazo compound 2.

Figure 5:
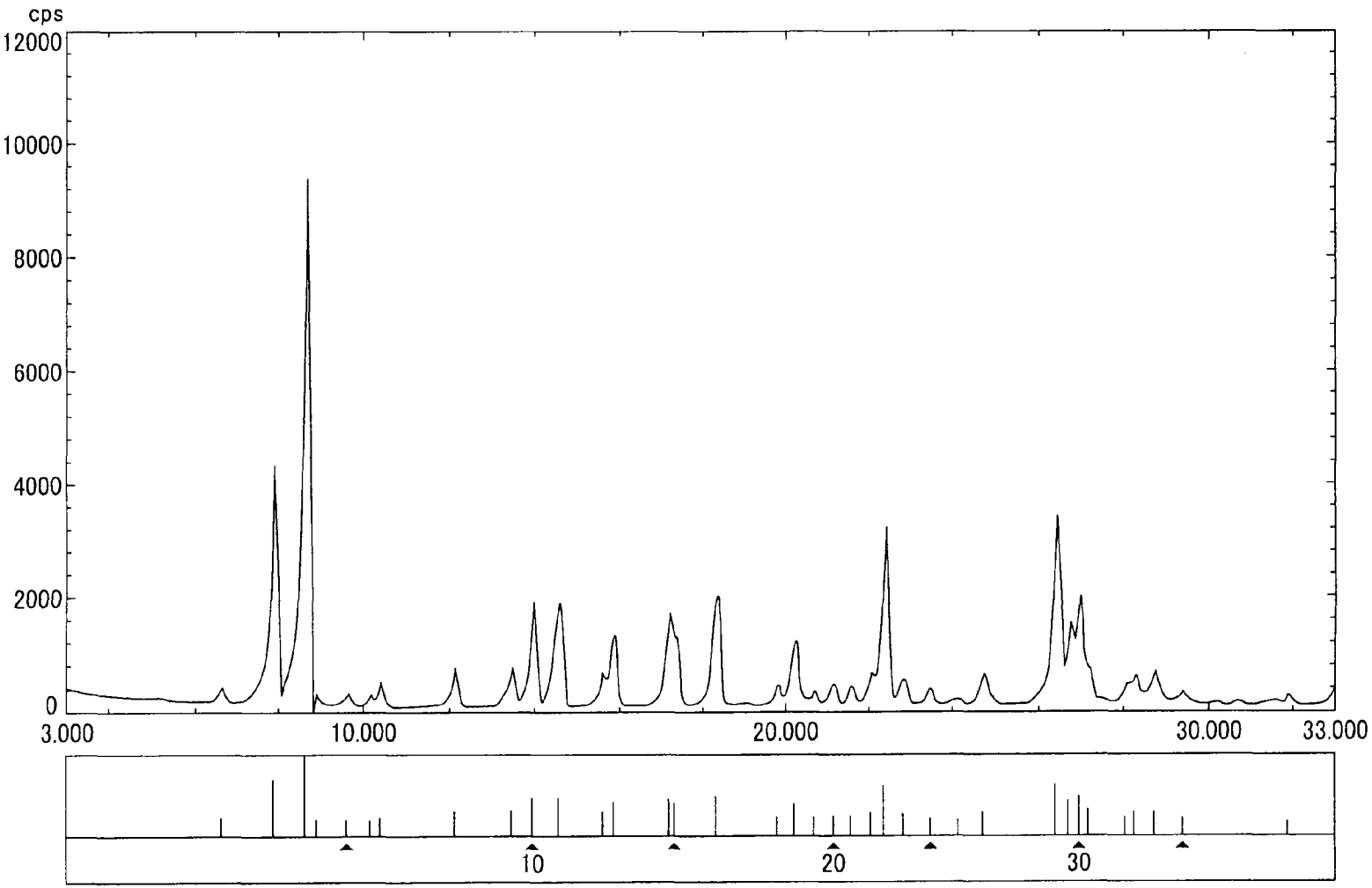
FIG. 5 is a diagram showing X-ray diffraction data of the chrome-containing monoazo compound 2.

The chrome-containing monoazo compound 2 included propyleneglycolmonomethylether in an amount of 0.9% by weight, and has a main peak at Bragg angle (2θ) of 8.660 in a CuKα X-ray diffraction spectrum. The peak strength was 9,400 cps at a tube voltage of 50 KV and a tube current of 30 mA. FIG. 5 is a diagram showing X-ray diffraction data of the chrome-containing monoazo compound 2.

(Synthesis of Chrome-Containing Monoazo Compound 3)

The following materials were mixed to prepare a mixture.

| | |
|---|---|
| Monoazo pigment prepared in (a) | 62.0 g |
| Chrome formate | 19.2 g |
| Propyleneglycolmonomethylether | 200 ml |

After the mixture was heated to have a temperature of 120° C. at 5° C./min and stirred for 8 hrs, the mixture was cooled to have a temperature of 10° C. at 10° C./min to prepare a reaction liquid. After a solid content was filtered from the reaction liquid through a paper filter and the solid content was washed with 100 ml of water on the paper filter to prepare a wet cake. After the wet cake was re-dispersed in an aqueous medium including 200 ml of water and 50 g of hydrochloric acid, heated in an oil bath to have a temperature of 80° C. and stirred for 1 hr, the dispersed wet cake was left cool to have room temperature. Then, after a solid content was filtered out again and washed with 1,200 ml of water, the solid content was dried at dried at 80° C. for 1 hr and further dried at 100° C. for 2 hrs, and pulverized to prepare a chrome-containing monoazo compound 3.

The chrome-containing monoazo compound 3 included propyleneglycolmonomethylether in an amount of 0.2% by weight, and has a main peak at Bragg angle (2θ) of 8.67° in a CuKα X-ray diffraction spectrum. The peak strength was 3,300 cps at a tube voltage of 50 KV and a tube current of 30 mA.

(Synthesis of Chrome-Containing Monoazo Compound 4)

The procedure for preparation of the chrome-containing monoazo compound 1 was repeated to prepare a chrome-containing monoazo compound 4 except for drying the solid content at 100° C. for 2 hrs.

The chrome-containing monoazo compound 4 included propyleneglycolmonomethylether in an amount of 1.1% by weight, and has a main peak at Bragg angle (2θ) of 8.67° in a CuKα X-ray diffraction spectrum. The peak strength was 12,000 cps at a tube voltage of 50 KV and a tube current of 30 mA.

(Synthesis of Chrome-Containing Monoazo Compound 5)

The following materials were mixed to prepare a mixture.

| | |
|---|---|
| Monoazo pigment prepared in (a) | 62.0 g |
| Chrome formate | 19.2 g |
| Propyleneglycolmonomethylether | 200 ml |

After the mixture was heated to have a temperature of 120° C. at 5° C./min and stirred for 8 hrs, the mixture was cooled to have a temperature of 30° C. at 15° C./min to prepare a reaction liquid. After a solid content was filtered from the reaction liquid through a paper filter and the solid content was washed with 100 ml of water on the paper filter to prepare a wet cake. The wet cake was re-dispersed in an aqueous medium including 200 ml of water and 15 g of hydrochloric acid, and stirred for 1 hr. Then, after a solid content was filtered out again and washed with 1,200 ml of water, the solid content was dried at 80° C. for 1 hr and further dried at 100° C. for 3 hrs, and pulverized to prepare a chrome-containing monoazo compound 5.

The chrome-containing monoazo compound 5 included propyleneglycolmonomethylether in an amount of 0.5% by weight, and has a main peak at Bragg angle (2θ) of 8.66° in a CuKα X-ray diffraction spectrum. The peak strength was 7,000 cps at a tube voltage of 50 KV and a tube current of 30 mA.

(Synthesis of Chrome-Containing Monoazo Compound 6)

The following materials were mixed to prepare a mixture.

| | |
|---|---|
| Monoazo pigment prepared in (a) | 62.0 g |
| Chrome formate | 19.2 g |
| Propyleneglycolmonomethylether | 300 ml |

After the mixture was heated to have a temperature of 120° C. at 5° C./min and stirred for 8 hrs, the mixture was cooled to have a temperature of 5° C. at 5° C./min to prepare a reaction liquid. After a solid content was filtered from the reaction liquid through a paper filter and the solid content was washed with 100 ml of water on the paper filter to prepare a wet cake. The wet cake was re-dispersed in an aqueous medium including 200 ml of water and 15 g of hydrochloric acid, and stirred for 1 hr. Then, after a solid content was filtered out again and washed with 1,200 ml of water, the solid content was dried at 80° C. for 1 hr and further dried at 100° C. for 3 hrs, and pulverized to prepare a chrome-containing monoazo compound 6.

The chrome-containing monoazo compound 6 included propyleneglycolmonomethylether in an amount of 0.6% by weight, and has a main peak at Bragg angle (2θ) of 8.670 in a CuKα X-ray diffraction spectrum. The peak strength was 14,000 cps at a tube voltage of 50 KV and a tube current of 30 mA.

(Synthesis of Chrome-Containing Monoazo Compound 7)

The following materials were mixed to prepare a mixture.

| | |
|---|---|
| Monoazo pigment prepared in (a) | 62.0 g |
| Chrome formate | 19.2 g |
| Propyleneglycolmonomethylether | 200 ml |

After the mixture was heated to have a temperature of 120° C. at 5° C./min and stirred for 8 hrs, the mixture was cooled to have a temperature of 40° C. at 20° C./min to prepare a reaction liquid. After a solid content was filtered from the reaction liquid through a paper filter and the solid content was washed with 100 ml of water on the paper filter to prepare a wet cake. The wet cake was re-dispersed in an aqueous medium including 200 ml of water and 15 g of hydrochloric acid, and stirred for 1 hr. Then, after a solid content was filtered out again and washed with 1,200 ml of water, the solid content was dried at 80° C. for 1 hr and further dried at 100° C. for 3 hrs, and pulverized to prepare a chrome-containing monoazo compound 7.

Figure 6:
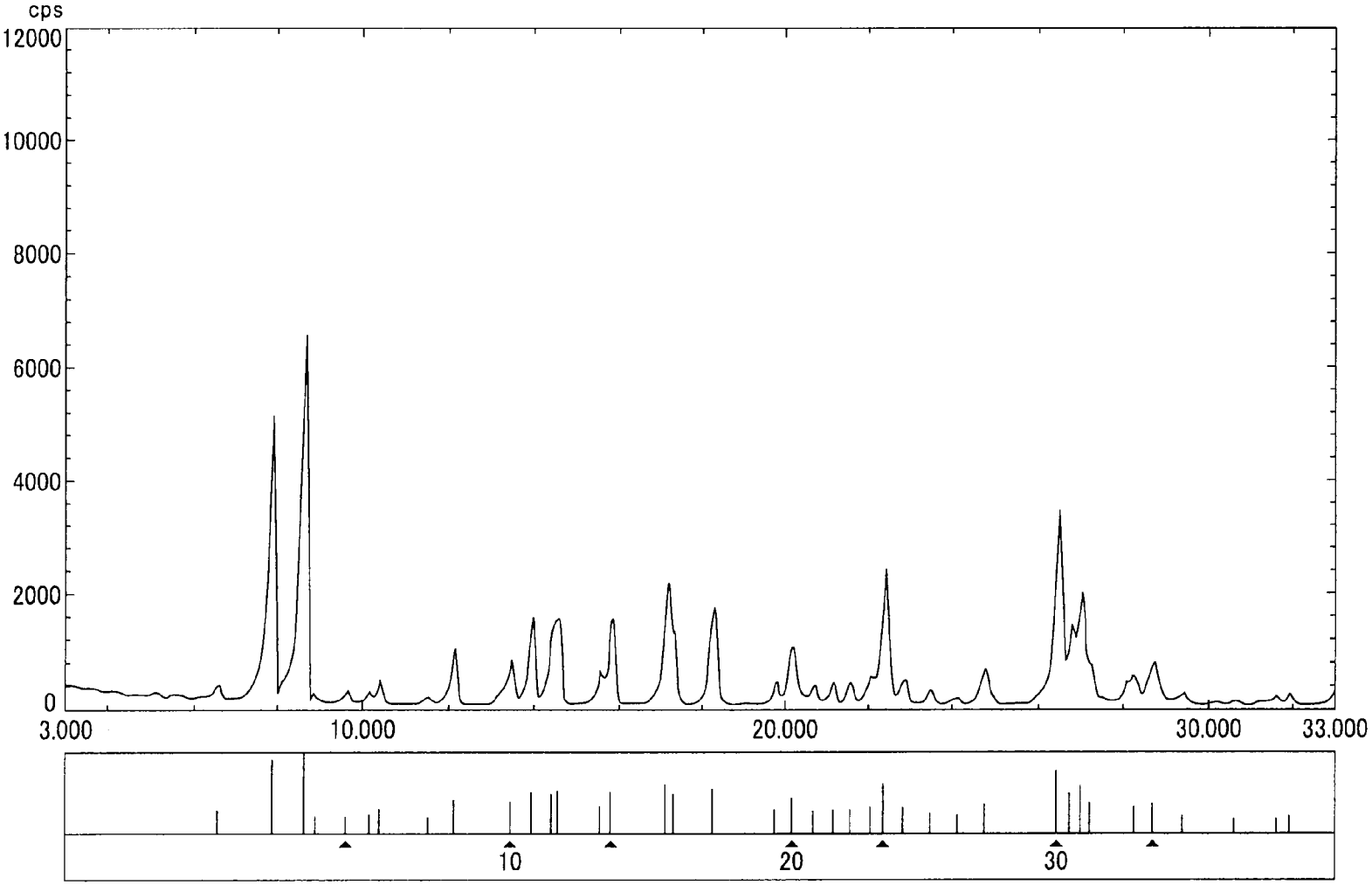
FIG. 6 is a diagram showing X-ray diffraction data of the chrome-containing monoazo compound 7.

The chrome-containing monoazo compound 7 included propyleneglycolmonomethylether in an amount of 0.6% by weight, and has a main peak at Bragg angle (2θ) of 8.68° in a CuKα X-ray diffraction spectrum. The peak strength was 6,500 cps at a tube voltage of 50 KV and a tube current of 30 mA. FIG. 6 is a diagram showing X-ray diffraction data of the chrome-containing monoazo compound 7.

(Synthesis of Chrome-Containing Monoazo Compound 8)

The procedure for preparation of the Chrome-Containing Monoazo Compound 1 was repeated to prepare a chrome-containing monoazo compound 8 except for replacing 200 ml of propyleneglycolmonomethylether with 200 ml of ethyleneglycolmonoethylether.

The chrome-containing monoazo compound 8 included propyleneglycolmonomethylether in an amount of 0% by weight, and has a main peak at Bragg angle (2θ) of 8.70° in a CuKα X-ray diffraction spectrum. The peak strength was 10,000 cps at a tube voltage of 50 KV and a tube current of 30 mA.

Example 1

The following materials were preliminarily mixed by Henschel Mixer FM10B from Mitsui Mining Co., Ltd. to prepare a mixture, and the mixture was kneaded by biaxial kneader PCM-30 from Ikegai Corp. at 140° C. to prepare a kneaded mixture.

| | |
|---|---|
| Resin 2 | 40 |
| Resin 3 | 40 |
| Chrome-containing monoazo compound 5 | 1 |
| Ester wax WA-2 from NOF Corp. | 9 |
| Carbon Black Regal 330R from Cabot Corp. | 10 |

The kneaded mixture was cooled and solidified to prepare a solid mixture. Next, the solid mixture was pulverized by an ultrasonic jet pulverizer LABOJET from Nippon Pneumatic Mfg. Co., Ltd. to prepare a pulverized mixture, and the pulverized mixture was classified by an airflow classifier MDS-1 from Nippon Pneumatic Mfg. Co., Ltd. to prepare mother toner particles having a particle diameter distribution shown in Table 1-1. 100 parts by weight of the mother toner particles and 2.0 parts by weight of colloidal silica H-2000 from Clariant Corp. were mixed by a sample mill to prepare a toner.

Next, the toner and silicone-coated carrier having an average particle diameter of 50 μm were mixed so as to have a toner concentration of 7% to prepare a developer.

Example 2

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 2 | 39 |
| Resin 3 | 39 |
| Chrome-containing monoazo compound 2 | 3 |
| Ester wax WA-2 from NOF Corp. | 9 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Example 3 to 6

The procedure for preparation of the mother toner particles in Example 1 was repeated to prepare respective mother toner particles except for changing the formulation to a following formulation and controlling an air pressure of the pulverizer and a suction air pressure of the classifier such that the respective mother toner particles had a particle diameter distribution shown in Table 1-1.

| | |
|---|---|
| Resin 3 | 80 |
| Chrome-containing monoazo compound 1 | 5 |
| Polypropylene VISCOL 660P from Sanyo Chemical industries, Ltd. | 5 |
| Carbon Black Regal 330R from Cabot Corp. | 10 |

100 parts by weight of the respective mother toner particles and 3.0 parts by weight of colloidal silica H-2000 from Clariant Corp. were mixed by a sample mill to prepare respective toners. Next, each of the toners and a silicone-coated carrier having an average particle diameter of 50 μm were mixed so as to have a toner concentration of 7% to prepare respective developers.

Example 7

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 3 | 80 |
| Chrome-containing monoazo compound 3 | 5 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Example 8

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 3 | 83 |
| Chrome-containing monoazo compound 4 | 2 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Example 9

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 1 | 82 |
| Chrome-containing monoazo compound 8 | 3 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Example 10

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 2 | 82 |
| Chrome-containing monoazo compound 6 | 3 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Example 11

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 2 | 82 |
| Chrome-containing monoazo compound 7 | 3 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Comparative Example 1

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 2 | 40 |
| Resin 3 | 40 |
| Chrome-containing monoazo compound 5 | 0.6 |
| Ester wax WA-2 from NOF Corp. | 9.4 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Comparative Example 2

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 1 | 82 |
| Chrome-containing monoazo compound 2 | 3 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

Comparative Example 3

The procedure for preparation of the mother toner particles in Example 1 was repeated to prepare mother toner particles except for changing the formulation to a following formulation and controlling an air pressure of the pulverizer and a suction air pressure of the classifier such that the mother toner particles had a particle diameter distribution shown in Table 1-1.

| | |
|---|---|
| Resin 2 | 82 |
| Chrome-containing monoazo compound 8 | 3 |
| Polypropylene VISCOL 660P from Sanyo Chemical industries, Ltd. | 5 |
| Carbon Black Regal 330R from Cabot Corp. | 10 |

100 parts by weight of the mother toner particles and 3.0 parts by weight of colloidal silica H-2000 from Clariant Corp. were mixed by a sample mill to prepare a toner. Next, the toner and silicone-coated carrier having an average particle diameter of 50 μm were mixed so as to have a toner concentration of 7% to prepare a developer.

<Evaluation Methods>

In all the evaluations, the toners stored in a constant-temperature reservoir having a temperature of 50±1° C. for 6 months were used.

(Image Quality Evaluation Method)

Each of the toners was set in Imagio neo 453 using a toner recycle method from Ricoh Company, Ltd., and an image after 100,000 images were produced at 25° C. and 60% Rh was evaluated.

Image density: 10 points on a black solid circular image having a diameter of 3 cm were measured by Macbeth densitometer and an average thereof was determined as image density.

Foggy images:

A: No foggy image

B: A slight foggy image which is no problem in practical use.

C: poor, a serious foggy image

Figure 7:
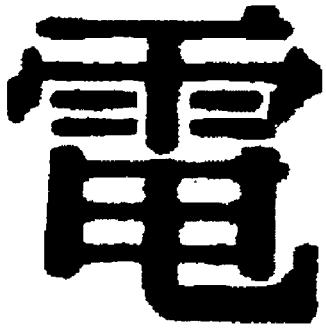
FIG. 7 is used as a standard for evaluating letter sharpness.
Figure 7:
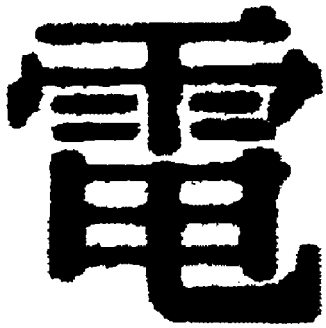
Figure 7:
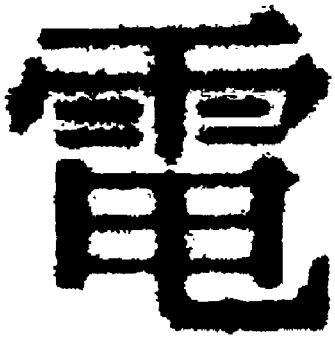

Sharpness: A letter "電" (2 mm×2 mm) was magnified 30 diameters to evaluate according to FIG. 7. Ranks 2 and 4 are between 1 and 3, and 3 and 5, respectively.

(Toner Aggregability Measurement Method)

The following accessories were set on an oscillation table of a powder tester from Hosokawa Micron Corp.

(1) vibroshoot
(2) packing
(3) space ring
(4) 3 sieves (upper, middle and lower)
(5) press bar These were fixed with a knob nut, and the oscillation table was operated. The measurement conditions are as follows:

Sieve mesh (upper): 200
Sieve mesh (middle): 350
Sieve mesh (lower): 635
Oscillation scale: 1 mm
Sample weight: 2 g
Oscillation time: 10 sec.

The aggregability was determined by the following formulae.

$$\text{(weight left on the upper sieve/original weight)}\times 100 \quad (a)$$

$$\text{(weight left on the middle sieve/original weight)}\times 100\times(3/5) \quad (b)$$

$$\text{(weight left on the middle sieve/original weight)}\times 100\times(1/5) \quad (c)$$

*Aggregation (%)=$(a)+(b)+(c)$

The charge quantity of the toner was measured by the following method. Further, after the developer was stored in a constant-temperature reservoir having a temperature of 50±1° C. for 6 months, the charge quantity of the toner was measured again thereby.

Figure 4:
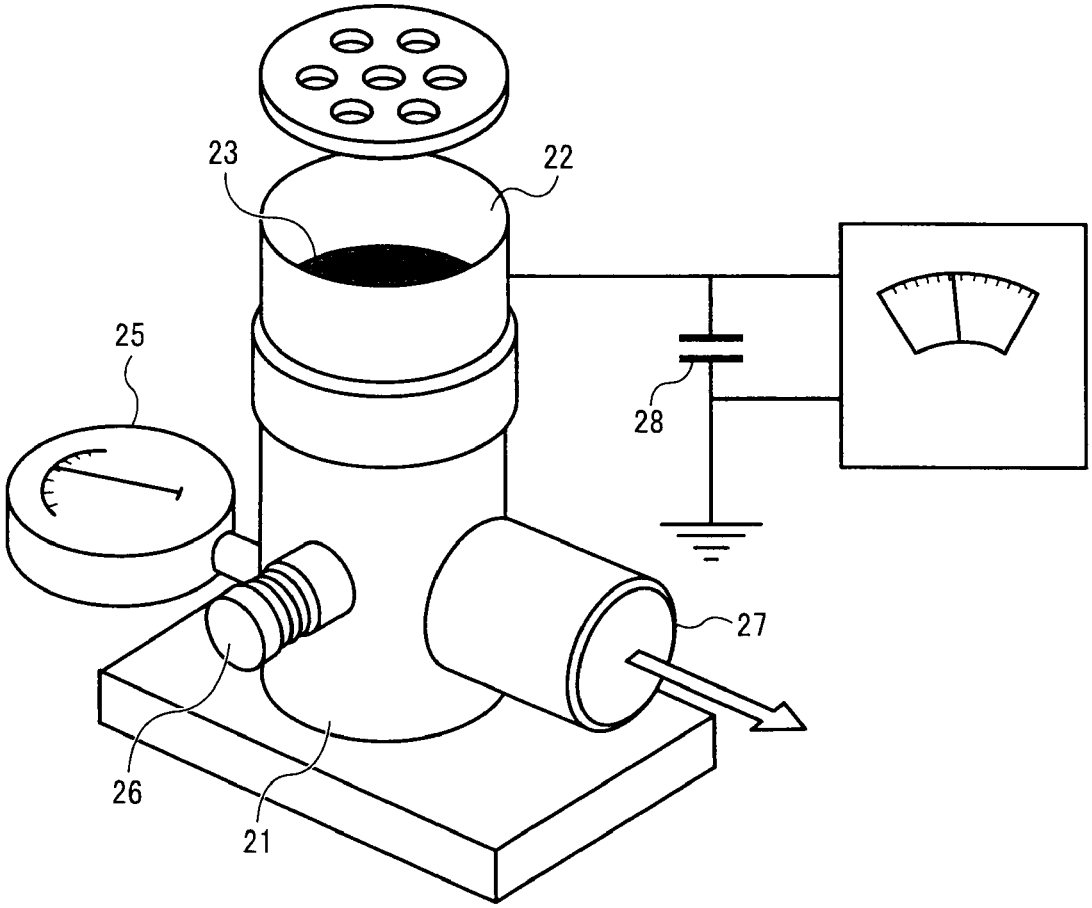
FIG. 4 is an explanatory view of charge quantity measurer.

50 g of the developer were placed in a polyethylene container, and left under an environment having a temperature of from 21 to 25° C. and a humidity of from 55 to 63% for 2 days. After the container was capped and vibrated by Turbular Mixer for 240 sec, 0.5 g of the developer were sampled and the friction charge quantity thereof was measured by a suction method. FIG. 4 is an explanatory view of charge quantity measurer. A sample was placed in a metallic measuring container 22 including an electroconductive screen 23 having 635 meshes (selectable as desired so as not to pass the carrier) at the bottom, and the container was capped with a metallic lid. Next, an air volume control valve of a suctioner 21 (a part contacting to the measuring container 22 was insulative) was adjusted such that a vacuum gauge 25 indicated a pressure of 250 mm $H_2O$. The sample was suctioned from a suction opening 27 for 1 min. Numeral 28 is a condenser having a capacity of C μF. The resultant charge quantity is divided by a quantity (g) of the suctioned toner to determine a friction charge quantity mC/kg.

The evaluation results are shown in Tables 1-1 and 1-2.

TABLE 1-1

| | PGMMME (ppm) | NAPD (μm) | NVC | Sharpness | Foggy images |
|---|---|---|---|---|---|
| Example 1 | 30 | 3.7 | 22.1 | 5 | A |
| Example 2 | 200 | 3.5 | 33.8 | 5 | A to B |
| Example 3 | 80 | 3.2 | 29.6 | 5 | A to B |
| Example 4 | 80 | 6.7 | 31.5 | 4 | A to B |
| Example 5 | 80 | 3.9 | 21.0 | 5 | A to B |
| Example 6 | 80 | 4.1 | 35.9 | 5 | A to B |
| Example 7 | 35 | 4.0 | 34.8 | 5 | A to B |

TABLE 1-1-continued

| | PGMMME (ppm) | NAPD (μm) | NVC | Sharpness | Foggy images |
|---|---|---|---|---|---|
| Example 8 | 170 | 5.3 | 32.8 | 5 | B |
| Example 9 | 55 | 6.1 | 25.6 | 4 | B |
| Example 10 | 120 | 6.5 | 27.9 | 4 | A to B |
| Example 11 | 100 | 5.8 | 27.9 | 4 | A |
| Comparative Example 1 | 20 | 3.9 | 28.2 | 5 | C |
| Comparative Example 2 | 240 | 4.5 | 31.1 | 4 | C |
| Comparative Example 3 | 0 | 5.2 | 26.1 | 4 | C |

*PGMMME: propyleneglycolmonomethylether in toner

NAPD: Number-average particle diameter

NVC: number variation coefficient

TABLE 1-2

| | Image density | Aggregation before stored (%) | Aggregation after stored (%) | Charge quantity before stored (−μc/g) | Charge quantity after stored (−μc/g) |
|---|---|---|---|---|---|
| Example 1 | 1.52 | 9 | 12 | 52 | 50 |
| Example 2 | 1.48 | 7 | 8 | 49 | 46 |
| Example 3 | 1.46 | 10 | 11 | 50 | 48 |
| Example 4 | 1.38 | 11 | 11 | 36 | 35 |
| Example 5 | 1.49 | 10 | 12 | 51 | 50 |
| Example 6 | 1.45 | 9 | 12 | 48 | 45 |
| Example 7 | 1.45 | 8 | 10 | 38 | 35 |
| Example 8 | 1.41 | 7 | 12 | 42 | 42 |
| Example 9 | 1.37 | 8 | 10 | 39 | 39 |
| Example 10 | 1.40 | 9 | 10 | 35 | 35 |
| Example 11 | 1.40 | 10 | 10 | 40 | 40 |
| Comparative Example 1 | 1.12 | 8 | 35 | 45 | 20 |
| Comparative Example 2 | 1.07 | 9 | 45 | 46 | 10 |
| Comparative Example 3 | 1.18 | 8 | 48 | 42 | 15 |

This application claims priority and contains subject matter related to Japanese Patent Application No. 2008-001847, filed on Jan. 9, 2008, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner for developing electrostatic latent images, comprising:

a binder resin; and a colorant, wherein the toner further comprises a chrome-containing monoazo compound synthesized in propyleneglycolmonomethylether, comprising propyleneglycolmonomethylether in an amount of from 0.3 to 0.9% by weight of the monoazo compound and having the following formula (1):

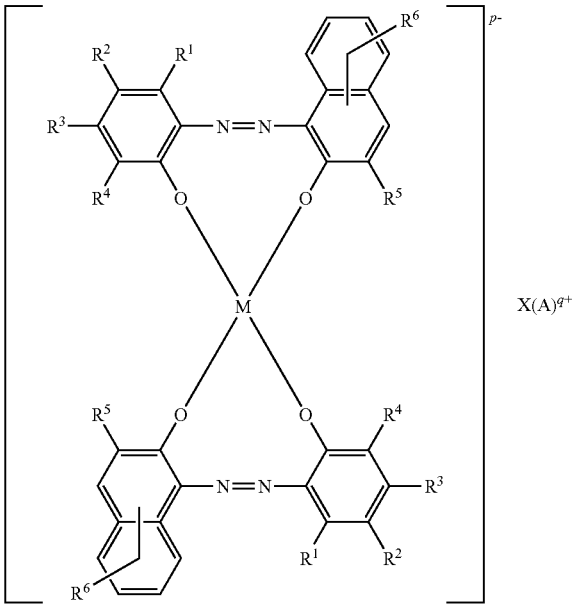

wherein $R^2$ is Cl; $R^1$ and $R^3$ to $R^6$ are hydrogen atoms; M is Cr; $(A)^{q+}$ is $H^+$; p is an integer 1 or 2, and X is an integer of 1 or 2, and wherein propyleneglycolmonomethylether is present in an amount of from 30 to 200 ppm based on the toner.

2. The toner of claim 1, wherein the toner has a weight-average particle diameter of from 3.5 to 6.5 μm, and a variation coefficient (a standard deviation of number distribution of the toner/number-average particle diameter thereof) of from 22.0 to 35.0.

3. The toner of claim 1, wherein the chrome-containing monoazo compound has a main peak at Bragg angle (2θ) in a range of from 8.64 to 8.68° in a CuKα X-ray diffraction spectrum when irradiated with the CuKα X-ray at an angle (2α) of from 5 to 30°.

4. The toner of claim 3, wherein the peak has a strength of from 7,000 to 13,000 cps at a tube voltage of 50 KV and a tube current of 30 mA.

5. An image forming method, comprising:

charging an image bearer with a charger upon external application of a bias thereto;

forming an electrostatic latent image on the image bearer;

developing the electrostatic latent image with the toner according to claim 1 to form a toner image;

transferring the toner image onto a transfer material with a transferer upon external application of a bias thereto;

cleaning the surface of the image bearer after transferring the toner image onto the transfer material; and fixing the toner image on the transfer material upon application of heat.

6. The image forming method of claim 5, wherein the cleaning step further comprises recycling the toner remaining untransferred on the surface of the image bearer.

7. The toner of claim 1, wherein the binder resin comprises at least one of a polyester resin or a styrene resin.

8. The toner of claim 1, wherein the binder resin comprises a polyester resin.

9. The toner of claim 7, wherein the toner additionally comprises a wax.

10. The toner of claim 8, wherein the toner additionally comprises a wax.

* * * * *